US007146776B2

(12) United States Patent
Matumoto et al.

(10) Patent No.: US 7,146,776 B2
(45) Date of Patent: Dec. 12, 2006

(54) HEAT SHIELDING MEMBER OF HOUSING

(75) Inventors: Setuya Matumoto, Sapporo (JP); Keiji Matumoto, Sapporo (JP)

(73) Assignee: Matumotokenkou Kabushiki Kaisha, Sapporo (JP)

( * ) Notice: Subject to any disclaimer, the term of this patent is extended or adjusted under 35 U.S.C. 154(b) by 447 days.

(21) Appl. No.: 10/685,775

(22) Filed: Oct. 14, 2003

(65) Prior Publication Data

US 2004/0231269 A1 Nov. 25, 2004

(30) Foreign Application Priority Data

May 22, 2003 (JP) ..... 2003-144968

(51) Int. Cl.
*E04C 2/32* (2006.01)

(52) U.S. Cl. ..... 52/783.11; 52/95; 52/302.1; 52/302.3; 52/783.17

(58) Field of Classification Search ..... 52/792.1, 52/95, 302.1, 302.3, 199; 428/138, 251, 428/268, 229

See application file for complete search history.

(56) References Cited

U.S. PATENT DOCUMENTS 3,884,009 A * 5/1975 Frohlich et al. ..... 52/745.06
4,691,482 A * 9/1987 Heinemann et al. ..... 52/3
5,596,847 A * 1/1997 Stephenson ..... 52/198

OTHER PUBLICATIONS

"Heat Shielding Member of Housing", Setuya Matumoto et al., Serial No. Unknown, filed Oct. 14, 2003.

* cited by examiner

*Primary Examiner*—Naoko Slack
*Assistant Examiner*—Tiara Robertson
(74) *Attorney, Agent, or Firm*—Flynn, Thiel, Boutell & Tanis, P.C.

(57) ABSTRACT

There is provided a heat shielding member for a thermal insulation structure which does not form a heat accumulator even if it receives a heating load from the outside and which is easily fixed and installed from the indoor side when it is applied to the thermal insulation structure between timbers such as rafters, vertical frames of a wall and the like of a house. The heat shielding member is structured such that spaces of the air layer are formed between an upper layer, an intermediate layer, and a lower layer, a radiant heat reflective layer is provided on upper faces of respective layers, and the upper layer is formed of a shape-retention upper sheet, wherein bent-up legs having restorability are disposed on both sides of the shape-retention upper sheet, and the heat shielding member is engaged and mounted between timbers such as rafters, and it is held in a proper posture when the bent-up legs are stretched against and held by faces of the timbers.

8 Claims, 9 Drawing Sheets

FIG. 8(A) (First Prior Art)
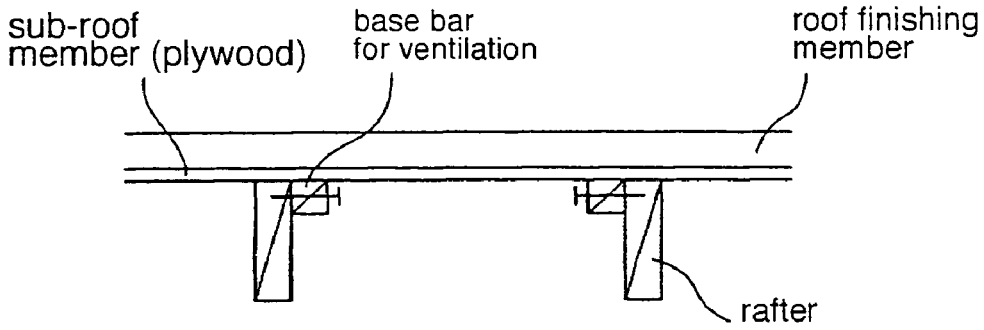
FIG. 8(B) (First Prior Art)
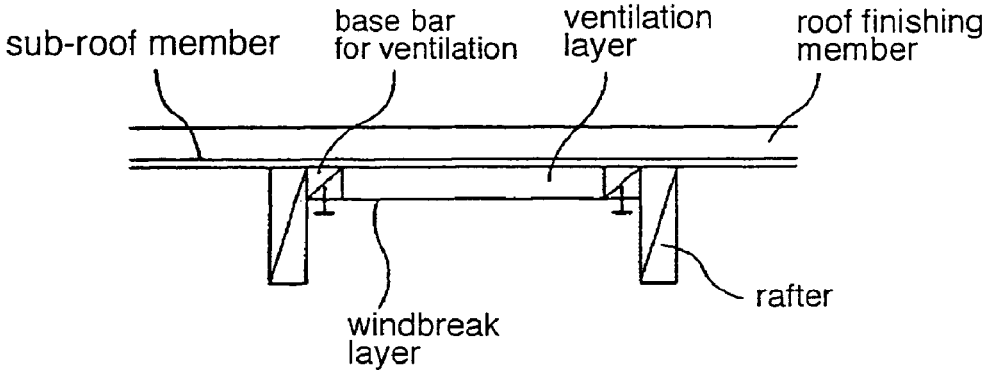
FIG. 8(C) (First Prior Art)
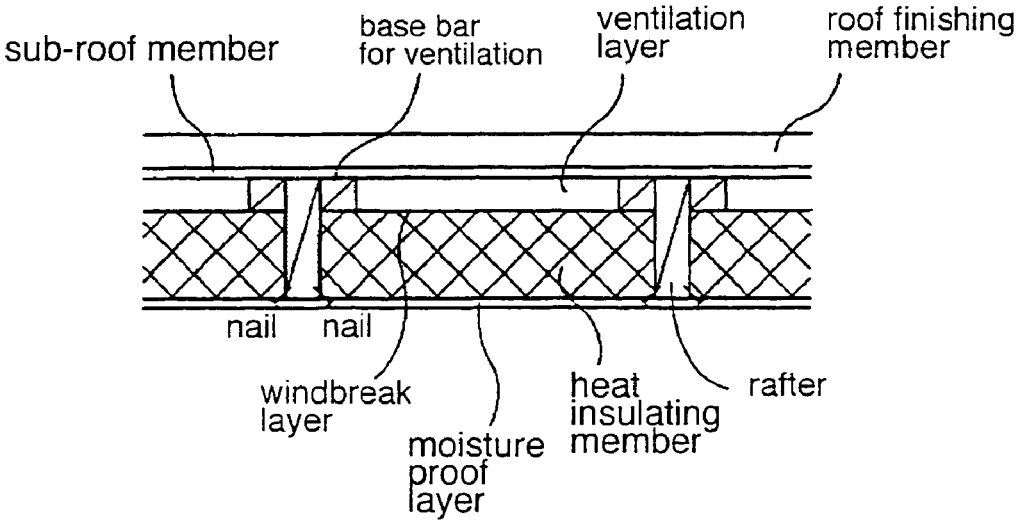

FIG. 9(A) (Second Prior Art)
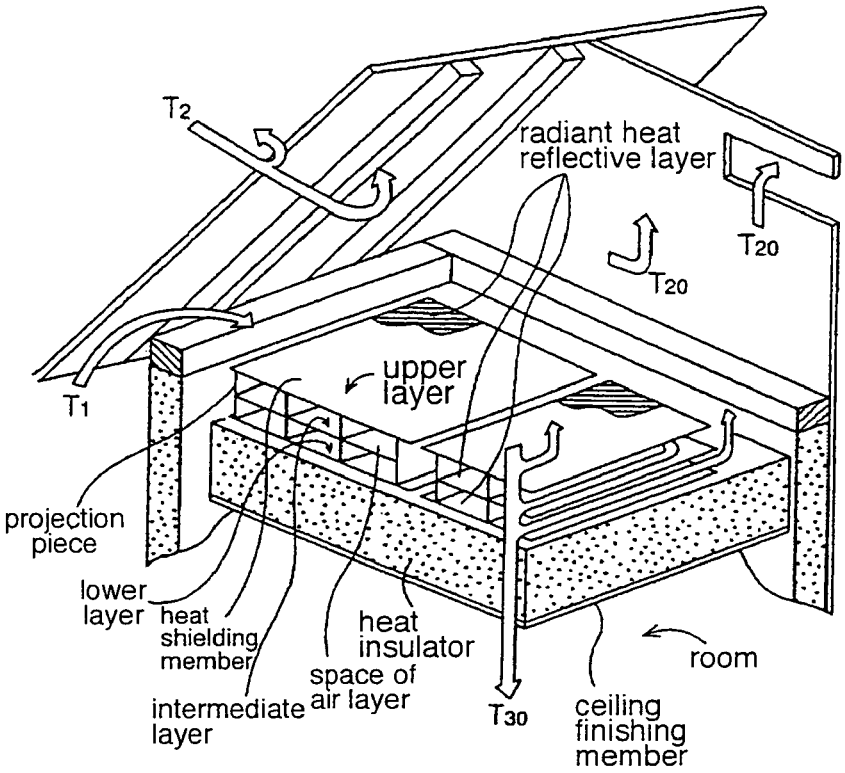
FIG. 9(B) (Second Prior Art)
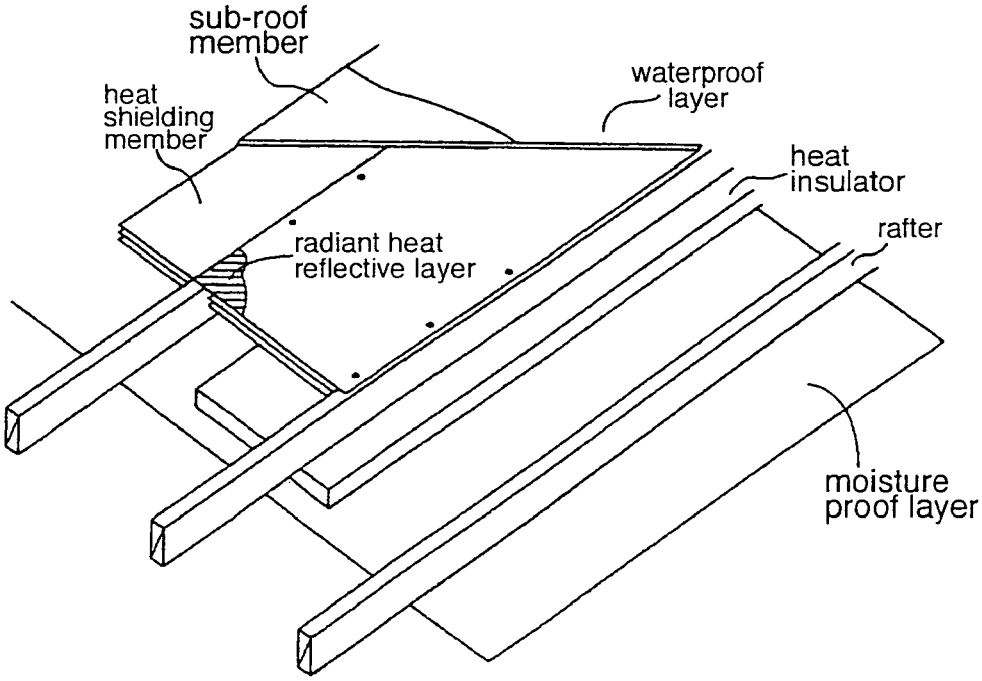

HEAT SHIELDING MEMBER OF HOUSING

FIELD OF THE INVENTION

The invention is intended to provide improvement on a thermal insulation structure of a house, and is related to a heat shielding member for shielding and restraining heat transfer relative to an outside, and belongs to a technical field of a housing construction.

BACKGROUND OF THE INVENTION

The technique as disclosed in a Non-Patent Reference is shown in FIG. 8, namely, in Item (6) of "thermal insulation of a roof" pp 192–193, extracted from a literature entitled "Explanation of Standard of Energy-Saving of Housing" published Jun. 1, 2002 by Foundation for Building Environment Energy Saving Organization, and it is a typical example of a thermal insulation of a roof of housing.

That is, rafters are fixed to a ridge pole, a purlin, a top plate and the like of a roof truss by nails, and a sub-roof member such as plywood and the like are fixed to the rafters by nails, then base bars for ventilation are fixed to the upper side surfaces of the rafters by nails as shown in FIG. 8(A), thereafter moisture-permeable waterproof sheet or a windbreak layer such as plywood and the like are fastened on the base bars for ventilation as shown in FIG. 8(B), thereby forming a ventilation layer between the sub-roof member and the windbreak layer.

Subsequently, as shown in FIG. 8(C), the heat insulators, which are cut to have a length corresponding to the interval between the rafters, are engaged between the rafters from an indoor side and fixed to the same by nails so as not to slide down, then the moisture-proof layer made of vinyl chloride or the like is fixed to the rafters by a tacker or the like from the lower side of the heat insulators.

FIG. 9 shows a heat shielding member as disclosed in Patent Reference which has been filed by the same applicant under No. 271,335, and laid open to public inspection Dec. 26, 2000 under No. 2000-355,989 and patented under U.S. Pat. No. 3,251,000.

That is, as shown in FIG. 9, the heat shielding member comprises an upper layer, an intermediate layer, a lower layer which have radiant heat reflective layers Re on upper faces thereof, and coupled with one another by a group of stand-up pieces which are freely laid down, wherein the respective spaces of an air layer are formed between respective layers for air ventilation. When the interior of an attic is subjected to thermal insulation, the heat shielding member is placed on a heat insulator disposed on a ceiling finishing member, as shown in FIG. 9(A), and the end edges of the upper layer of the heat shielding member are fixed to a structure member and the like, thereby keeping a stand-up state of the heat shielding member.

Further, when the roof is subjected to thermal insulation, as shown in FIG. 9(B), the heat shielding member is engaged between the rafters from the above and both sides of the upper layer are fixed to the upper surfaces of the rafters by a tacker or the like, then the heat insulator is brought into contact with the lower face of the heat shielding member and fixed to the same by nails and the like, thereafter a moisture-proof layer provided on the lower face of the heat insulator is fixed to the rafters by a tacker and the like, subsequently, a sub-roof member is disposed on the upper face of the heat shielding member and nailed and fixed to the rafters, and finally a waterproof layer and a roof finishing member are extended on the sub-roof member.

According to the first prior art shown in FIG. 8, although a ventilation layer, which is effective for discharging heat caused by high temperature heating from a roof surface, is formed, and an insulator having a desired thickness can be provided by selecting the height of the rafters, the heat insulator becomes an accumulation body having a large capacity owing to the heating from the roof, and hence even if the outside air temperature is lowered at night, the heat insulator continues to discharge heat, which deteriorates the indoor environment, requiring a long run of an air conditioner for cooling.

Further, according to the second prior art as shown in FIG. 9 which is an improvement of the thermal insulation structure of the first prior art, although the amount of heat accumulation in the heat insulator can be significantly restrained because the heat insulator is covered with the heat shielding member, the heat shielding member lacks in independence, and hence fixing and installation of the upper layer of the heat shielding member to the peripheral structure member are needed for holding the heat shielding member at a predetermined position. Accordingly, when the heat shielding member is applied to the thermal insulation of the roof as shown in FIG. 9(B), after the heat shielding member is fixed to the rafters, the sub-roof member needs to be extended on the heat shielding member 1, and when providing the heat shielding member, the installation from the indoor side is impossible and requires a complex, difficult and dangerous operation at high place from the top of the roof.

Still further, since the operation of providing the heat shielding member precedes the operation of extending the sub-roof member and the waterproof layer, this can not be effected in a rainy weather. If the heat shielding member gets wet during the provision thereof, causing a problem of mold growth and rot during the service life of a house.

SUMMARY OF THE INVENTION

The invention has been developed to improve or solve the problems of the first and second prior arts and to provide a heat shielding member capable of restraining heat accumulation in a heat insulator and of easily being provided and installed.

The present invention relates to a heat shielding member of a house, for example, as shown in FIG. 1, comprising a plurality of layers 1A, 1B, 1C comprised of an upper layer 1A including at least a shape-retention upper sheet 12 and a lower layer 1C made up of a lower sheet 15, spaces (S1, S2) of an air layer formed between respective layers which are coupled by a group of stand-up pieces 16, 17 and having an opening enabling ventilation in the longitudinal direction, radiant heat reflective layers Re provided on respective upper faces of the layers 1B, 1C for defining bottom faces of the respective spaces S1, S2 of the air layer and an upper face of the upper layer 1A, and the shape-retention upper sheet 12 having bent-up legs 12L, 12R at both sides and having restorability at bent-up parts 12S.

Meanwhile, the multiple layer may be two layers formed of the upper layer 1A and the lower layer 1C or may be triple-layers formed of the upper layer 1A, the intermediate layer 1B, and the lower layer 1C or not less than four layers including multiple intermediate layers.

Further, the spaces S1, S2 of the air layer formed between the respective layers 1A, 1B, 1C may be sufficient if a natural convection of air is generated therein and they may be provided with an interval Sh of layer in the range of 10 to 20 mm.

Still further, the shape-retention upper sheet 12 may be sufficient to be a sheet capable of maintaining flatness of the upper layer 1A during the service life thereof, and the bent-up legs 12L, 12R disposed at both sides thereof by way of the bent-up parts 12S are sufficient to have a strength and restorability for preventing the heat shielding member 1 from being deformed and laid down when it is brought into contact with side members thereof, and hence the shape-retention upper sheet 12 may be made up of plastic sheet or thick kraft paper and the like, typically represented by corrugated paper having 3 mm thickness.

Further, the lower sheet 15, and a sheet for the intermediate layer which is disposed, if necessary, and the stand-up pieces 16, 17 and the like can be structured by a sheet member capable of keeping a flat shape during the service life thereof, typically represented by kraft paper.

Further, the radiant heat reflective layer Re is preferably made up of a metalized film or a metal foil which is excellent in heat reflection, and typically made up of an aluminium foil stuck layer.

Further, "restorability" means property to return from a bent-up state to a flat state, and if the bent-up legs 12L, 12R have the restorability, they exert a restoring force F0, as shown in FIG. 2, about the bent-up parts 12S serving as reference points.

The bent-up legs 12L, 12R are sufficient to perform stretch supporting operation owing to the restoring stress or force F0 so that the heat shielding member 1 is not deformed or laid down during the service life thereof, and the lengths thereof may be selected, if necessary.

Further, the width of the lower sheet 15 may include the width of the extension parts 15L, 15R if they are provided as shown in FIG. 1, or may be the same as the width W2 between the bent-up parts 12S of the upper layer 1A as shown in FIG. 5.

Accordingly, since the bent-up legs 12L, 12R which are disposed at both sides of the shape-retention upper sheet 12 by way of the bent-up parts 12S has a shape retention strength and restorability, in cases where the heat shielding member 1 is engaged between and applied to the rafters 3, for example, as shown in FIG. 2, the bent-up legs 12L, 12R having shape retention strength are brought into contact with the side faces 3F of the rafters 3 serving as structural members at both side thereof in a stretched state owing to the restoring force F0 about the bent-up parts 12S serving as reference points, whereas in cases where the heat shielding member 1 is engaged and applied between the vertical frames 30 as shown in FIG. 6(A), the bent-up legs 12L, 12R are brought into contact with the side faces 30F of the vertical frames 30 serving as structural members at both side thereof in a stretched state owing to the restoring force F0 about the bent-up parts 12S, so that the bent-up legs 12L, 12R prevent the heat shielding member 1 from being deformed or laid down, and also prevent air over the upper layer 1A (air in the space S0 of an air layer) from entering a space of an air layer S3 at the side faces of the heat shielding member 1, thereby completely assuring the radiant heat reflecting operation on the upper layer 1A, the intermediate layer 1B, and the lower layer 1C, and the air ventilation in the spaces S1, S2 of the air layer between respective layers and the space S0 of the air layer over the upper layer 1A and the space S3 of the air layer outside the stand-up pieces 16, 17.

Then, a heat applied to the heat shielding member 1 from the sub-roof member 4 and the sub-wall member 40 which are rendered high in temperature by heating from the outdoor side is prevented from being transferred to the interior of the heat shielding member 1 owing to the radiant heat reflection operation on the upper layer 1A, while a small amount of heat transferred from the upper layer 1A to the interior of the heat shielding member 1 is discharged by gentle air current from the spaces S0, S1, S2 of the air layer owing to the radiant heat reflection operation on the intermediate layer 1B and/or lower layer 1C, thereby preventing the heat from the upper (exterior) portion of the upper layer 1A from being transferred to the lower (interior) portion of the lower layer 1C.

Accordingly, the heat shielding member 1 which is applied as shown in FIGS. 2 and 6(B) provides a heat insulating structure having no heat accumulation function.

Further, when the heat shielding member 1 is superimposed on the upper face (outside face) of the heat insulator 2 as shown in FIG. 3 or FIG. 6(B), the heat shielding member 1 significantly mitigates the heating load applied to the heat insulator 2 so that the amount of heat accumulation in the heat insulator 2 can be significantly reduced as well as the thickness of the heat insulator 2 being rendered thin.

There are provided stand-up pieces 16, 17 wherein the stand-up pieces 16 are positioned at both ends of the stand-up pieces 16, 17 (hereinafter referred to as end stand-up pieces 16) and the stand-up piece 17 is positioned between both the end stand-up pieces 16 (hereinafter referred to as intermediate stand-up piece 17).

It is desirable that the heat shielding member 1 is structured such that both the outer faces 16F of both the end stand-up pieces 16 and both upper and lower faces of the lower sheet 15 have the radiant heat reflective layers Re, and the pin holes ho for moisture permeability are dispersedly disposed on the entire faces of the intermediate sheet 14 and the lower sheet 15 constituting the intermediate layer 1B.

In this case, each of the pin holes ho is formed by subjecting a sheet member provided with the radiant heat reflective layer Re made up of the aluminium foil and the like to a needling process.

Owing to the existence of the pin holes ho for moisture permeability, both the spaces S1, S2 of the air layer inside the heat shielding member 1 are rendered to be moisture permeable while communicating with each other, dew condensation and mold growth can be restrained in the heat shielding member 1, thereby restraining the contamination of the radiant heat reflective layer Re during the service life thereof to improve the durability of the reflection function.

Further, owing to the radiant heat reflective layers Re on the outer faces 16F of both the end stand-up pieces 16, the radiant heat inside the space S3 of the air layer formed between the bent-up legs 12L, 12R and both the end stand-up pieces 16 can be preferably discharged by the ventilation inside the space S3.

Still further, the radiant heat reflective layer Re on the bottom face 15B of the lower sheet 15 can restrain the loss of the indoor heat to the outside when the indoor temperature is higher than the outdoor temperature in a winter season or the like, which is advantageous for reducing indoor heating energy.

Further, it is desirable that the heat shielding member 1 is structured such that the upper layer 1A is made up of the upper sheet 13 and the shape-retention upper sheet 12 laminated to the upper sheet 13, and the group of stand-up pieces 16, 17 are coupled and fixed to the lower sheet 15 and the upper sheet 13 to be freely laid down.

Meanwhile, since the upper sheet 13 may be sufficient to fix and hold the group of the stand-up pieces 16, 17 by an adhesive and the like and it is fixed to the lower face of the shape-retention upper sheet 12 by an adhesive and the like, the width 13W (W2) of the upper sheet 13 may be sufficient to have any dimension by which both the end stand-up pieces 16 of the shape-retention upper sheet 12 can be fixed to the upper sheet 13 and which does not interfere with the bending of the bent-up legs 12L, 12R.

In this case, since a heat shielding member body 10 formed by coupling the thin upper sheet 13 and the lower sheet 15 by the group of stand-up pieces 16, 17 which are freely laid down is prepared in advance, and the thick shape-retention upper sheet 12 having a strength and the restorability is laminated to the upper sheet 13 of the heat shielding member body 10, if necessary, thereby fabricating the heat shielding member 1, and also the desired intermediate sheet 14 can be disposed between the stand-up pieces 16, 17 as shown in FIG. 4 when preparing the heat shielding member body 10, the fabrication and storage of the heat shielding member 1 can be made easy.

Further, it is desirable that the heat shielding member 1 is structured such that end edges 13E of the upper sheet 13 define the bent-up parts 12S of the bent-up legs 12L, 12R of the shape-retention upper sheet 12, and the lower sheet 15 has the same width W2 as the upper sheet 13.

In this case, since the flat face width W1 between the bent-up parts 12S at both sides of the shape-retention upper sheet 12 is reinforced by the lamination of the upper sheet 13, a degree of freedom of the selection of a material of the shape-retention upper sheet 12 increases.

Further, the width of the heat shielding member 1 becomes the width W1 of the upper sheet 13 plus inclined protrusion widths W0 of the bent-up legs 12L, 12R when the bent-up legs 12L, 12R are inclined sideward, and the inclined protrusion width W0 is determined by the manner of use of the heat shielding member 1, and hence the heat shielding member 1 can be engaged in the rafters 3 having interval which is the same width as or greater than the flat face width W1 as shown in FIG. 5, so that the heat shielding member 1 is advantageous in that the heat insulator 2 is bonded to the bottom face 15B of the lower sheet 15, and also advantageous in that multiple heat shielding members 1 are placed on the heat insulator 2 inside an attic and the like in parallel with one another.

It is desirable that the heat shielding member 1 is structured such that the upper layer 1A is the shape-retention upper sheet 12 and the group of the stand-up pieces 16, 17 are fixed between the lower sheet 15 and the shape-retention upper sheet 12 to be freely laid down.

In this case, if a material of the shape-retention upper sheet 12 is properly selected, it is possible to fabricate the shape-retention upper sheet 12 having necessary bending strength and restorability and the thin lower sheet 15 and the thin stand-up pieces 16, 17 by bonding therebetween, wherein since the upper sheet 13 is omitted, the structure of the heat shielding member 1 is simplified to reduce the fabricating cost of the heat shielding member 1.

Further, it is desirable that the heat shielding member 1 is structured such that the lower sheet 15 has extension parts 15L, 15R at both sides thereof.

In this case, the heat shielding member 1 alone can form not only the thermal insulation structure without using the heat insulator 2 while utilizing the extension parts 15L, 15R for fixing to the structure member such as the rafters 3 and the like as shown in FIG. 2, and also the heat shielding member 1 expands its utilization because it can be engaged between structure members (rafters) together with the heat insulator 2 while the extension parts 15L, 15R are bent when the heat insulator 2 is disposed on the bottom face 15B of the lower sheet 15 as shown in FIG. 3.

Further, it is desirable that the heat shielding member 1 is structured such that the shape-retention upper sheet 12 defines the flat face width W1 of the upper layer 1A between the bent-up parts 12S, and has the bent-up legs 12L, 12R having the dimensions which are substantially the same as the height h1 between the bent-up parts 12S and the lower sheet 15.

In this case, the bent-up legs 12L, 12R perform the function of the reinforcing members of the stand-up pieces 16, 17 when the heat shielding member 1 is engaged and pressed between the structure member to render the pressing operation easy, so that the deformation of the heat shielding member 1 caused by the deformation of the stand-up pieces 16, 17 is restrained to the minimum, so that the heat shielding member 1 is easily fixed and installed.

Further, it is desirable that the heat shielding member 1 is structured such that the shape-retention upper sheet 12 is made up of corrugated paper and the other sheets 13, 14, 15 and the stand-up pieces 16, 17 are made up of kraft paper, and also the radiant heat reflective layer Re is made up of an aluminum foil stuck layer.

In this case, the corrugated paper has a thickness of about 3 mm and typically made up of a corrugating medium covered with front and back kraft paper laminated thereto.

Since respective constituent members of the heat shielding member 1 are made up of kraft paper, respective constituent members can be well bonded to one another so that the heat shielding member 1 made of paper can be easily fabricated by bonding thereof.

Further, the aluminium foil stuck layer has a smooth reflection face and is capable of providing the radiant heat reflective layer Re of high performance with low cost.

BRIEF DESCRIPTION OF THE DRAWINGS

FIG. 3 is a front view for explaining a fixing operation when a heat insulator is provided on the heat shielding member of FIG. 1, wherein

FIG. 4 is a front view of a heat shielding member according to a first embodiment of the invention, wherein

FIG. 5 is a view for explaining the heat shielding member of FIG. 4 used integrally with the heat insulator, wherein

FIG. 6 is a front view for explaining a heat shielding member according to a third embodiment of the invention, wherein

FIG. 7 is a perspective view showing the application of the heat shielding member of FIG. 6 to a thermal insulation of a ceiling, wherein

FIG. 8 is a front view for explaining a first prior art, wherein FIG. 8(A) shows a state of fixing base bars for ventilation, FIG. 8(B) shows a state of forming a ventilation layer, and FIG. 8(C) shows a state of forming a thermal insulation structure; and FIG. 9 is a perspective view for explaining a second prior art, wherein FIG. 9(A) shows a thermal insulation structure on a ceiling finishing member, and FIG. 9(B) is a view showing a thermal insulation of a roof.

PREFERRED EMBODIMENT OF THE INVENTION

Fabrication of a heat shielding member:

First Embodiment

Figure 4A:
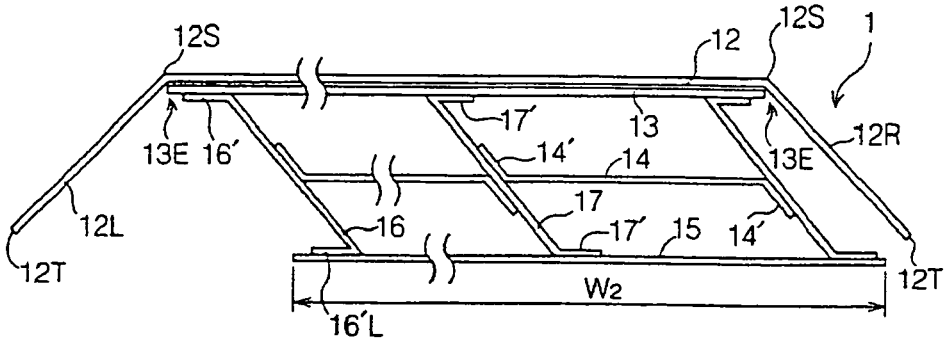
FIG. 4(A) is a view showing a state where the heat shielding member is raised up from a stacked form.
Figure 4B:
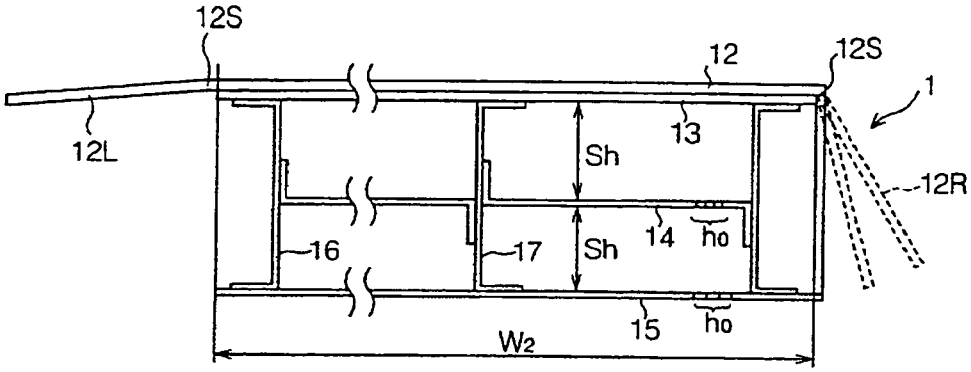
FIG. 4(B) shows a stand-up state of the stand-up pieces and FIG. 4(C) is a view showing a state where a heat shielding member body is separated from the upper layer.

Both the Lower Sheet and Upper Sheet are the Type Having the Same Width [FIGS. 4 and 5]

A heat shielding member 1 shown in FIG. 4 comprises an upper sheet 13, an intermediate sheet 14 and a lower sheet 15 and forms a heat shielding member body 10 having triple-layers wherein the lower sheet 15 has a width W2 which is the same dimension as the upper sheet 13, and the shape retention upper sheet 12 is laminated to the upper face of the upper sheet 13 of the heat shielding member body 10 to be integrated therewith.

The constituent members of the heat shielding member body 10 are made up of paper such that the intermediate stand-up piece 17 and the upper sheet 13 are made up of kraft paper (paper 1) of 165 g/m$^2$ and the lower sheet 15 is made up of kraft paper of 165 g/m$^2$ and a polyethylene film provided with an aluminum foil of 6.3 μm (paper 2) which is laminated to both faces or both sides of the kraft paper (paper 2), and the intermediate sheet 14 is made up of kraft paper of 70.8 g/m$^2$ and a polyethylene film provided with an aluminum foil of 6.3 μm which is laminated to either side of the kraft paper (paper 3).

Further, both the end stand-up pieces 16 are made up of kraft paper of 165 g/m$^2$ and a polyethylene film provided with an aluminum foil of 6.3 μm which is laminated to either side of the kraft paper (paper 4), and the shape-retention upper sheet 12 is made up of corrugated paper of 3 mm (double sided paper: 180 g/m$^2$, corrugating medium: 120 g/m$^2$) and a polyethylene film provided with an aluminum foil of 6.3 μm which is laminated to the face of the corrugated paper (paper 5).

Then, both the intermediate sheet 14 and the lower sheet 15 are subjected to a needling process to have pin holes (minuscule holes) ho, and the pin holes ho are dispersely disposed on the intermediate sheet 14 and the lower sheet 15.

The heat shielding member 1 is fabricated to have a long sheet in lengthwise dimension and it is cut at an appropriate length corresponding to an applied position when used.

Figure 1:
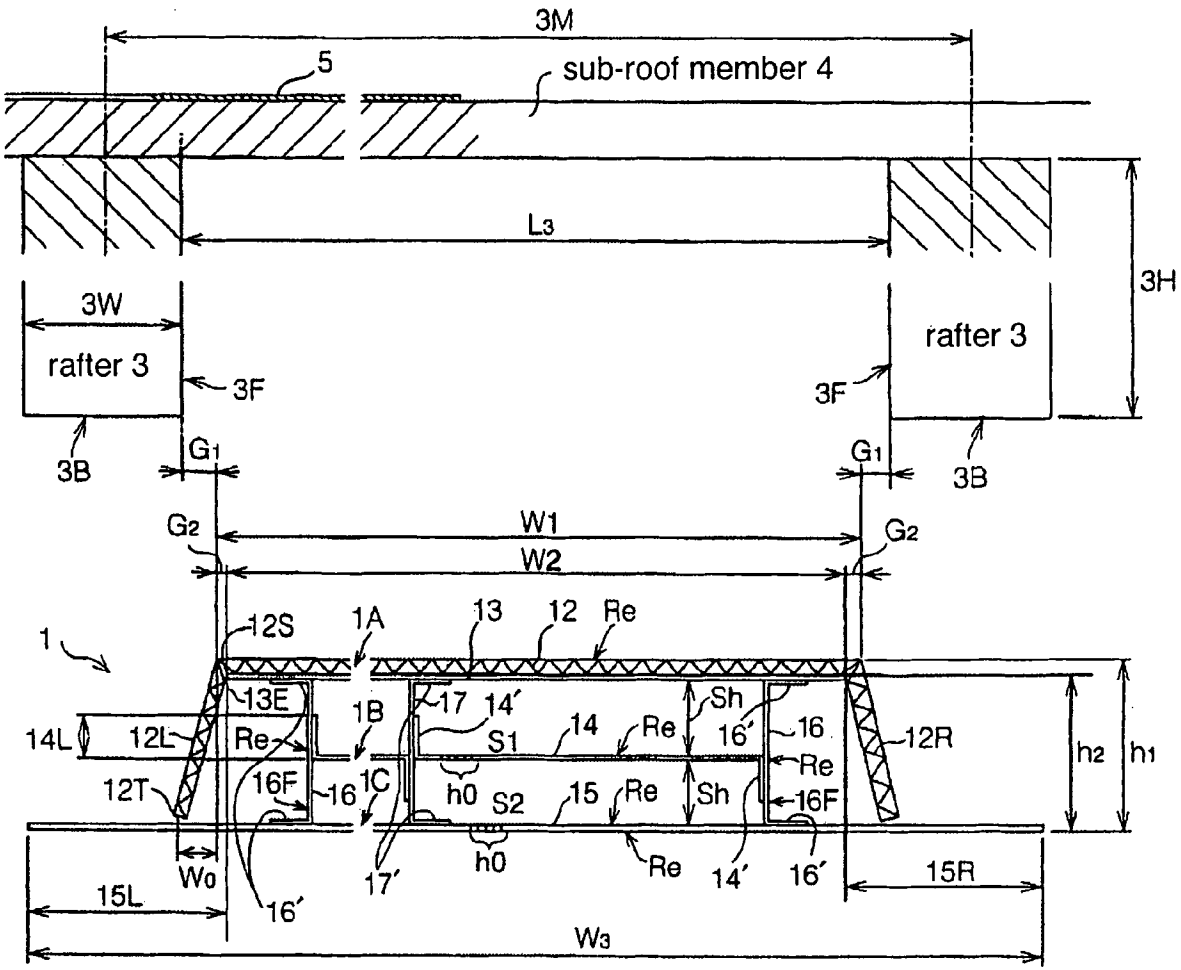
FIG. 1 is a front view of a heat shielding member according to a second embodiment of the invention.

Further, a widthwise dimension of the heat shielding member 1 is determined corresponding to the applied position. For the heat shielding member 1 for use in thermal insulation of a roof, as shown in FIG. 1, provided that the width 3W of the rafters 3 is 38 mm, the height 3H of the rafters 3 is 89 mm, and the interval dimension 3M between the cores of the rafters 3 is 500 mm, an interval L3 between the rafters 3 at both sides of the heat shielding member 1 becomes 462 mm while the flat face width W1 of the upper layer 1A of the heat shielding member 1 is set at 425 mm, and the width W2 of the upper sheet 13 is set at about 420 mm so as to assure even the bending of the end edges 13E at right angles at the bent-up parts 12S of the shape-retention upper sheet 12, and the width of the lower sheet 15 is also set at width W2 so as to set a spacing G1 between both sides of the upper layer 1A and the side faces 3F of the rafters at about 7.5 mm.

Further, the height hi becomes 38 mm obtained by adding 35 mm which is the effective height of the heat shielding member body 10 to 3 mm which is the thickness of the shape-retention upper sheet 12 (corrugated paper).

Figure 4C:
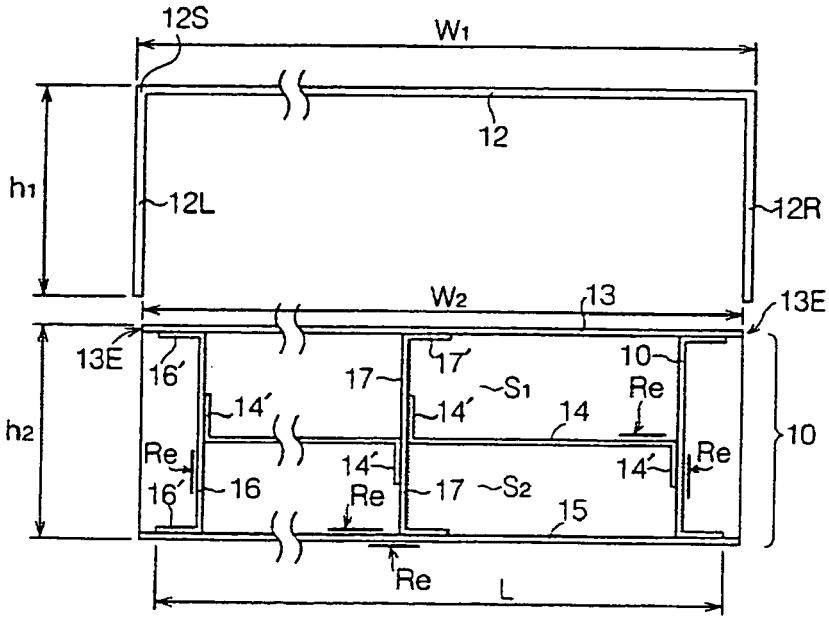

The heat shielding member body 10 is structured, as shown in FIG. 4(C), such that both the end stand-up pieces 16 and the intermediate stand-up piece 17 are bonded and fixed to the upper sheet 13 and the lower sheet 15 by the agency of bent pieces 16', 17' provided at upper and lower ends thereof and having the width of 10 mm while keeping the effective height h2 of the heat shielding member body 10 (standard: 35 mm), and the intermediate sheet 14 are bonded to and integrated with the stand-up pieces 16, 17 by bent pieces 14' provided at both ends thereof and having the width of 10 mm, thereby forming the spaces S1, S2 of the air layer between the respective sheets 13, 14, 15 where natural convection of air is possible, and wherein respective bent pieces 14', 16', 17' of the intermediate sheet 14 and the stand-up pieces 16, 17 are subjected to a flow process comprising the steps of bending→providing an adhesive→press-bonding by the group of rolls (not shown) so that the heat shielding member body 10 is fabricated in a stacked form.

It is needless to say that the fabrication of the heat shielding member body 10 may be carried out by hand.

Then, the shape-retention upper sheet 12 made up of the thick corrugated paper (Paper 5) is placed on the upper sheet 13 of the heat shielding member body 10 fabricated by thin kraft paper (Papers 1, 2, 3, 4) in a manner that the face of the aluminum foil is directed upward and the wavelike ridges of the corrugating medium are directed in the width direction of the upper sheet 13, then the shape-retention upper sheet 12 and the upper sheet 13 are bonded to each other at the flat face between the bent-up parts 12S at both sides of the shape-retention upper sheet 12.

In this case, the shape-retention upper sheet 12 is bonded to the upper sheet 13 while providing extension part for the bent-up legs 12L, 12R each having a length of the height hi (standard: 38 mm) between the bent-up parts 12S and the lower sheet 15 at both sides in the width direction, whereas when the bent-up legs 12L, 12R are bent at right angles, they are formed to cover the side faces of the heat shielding member body 10.

Second Embodiment

Figure 2:
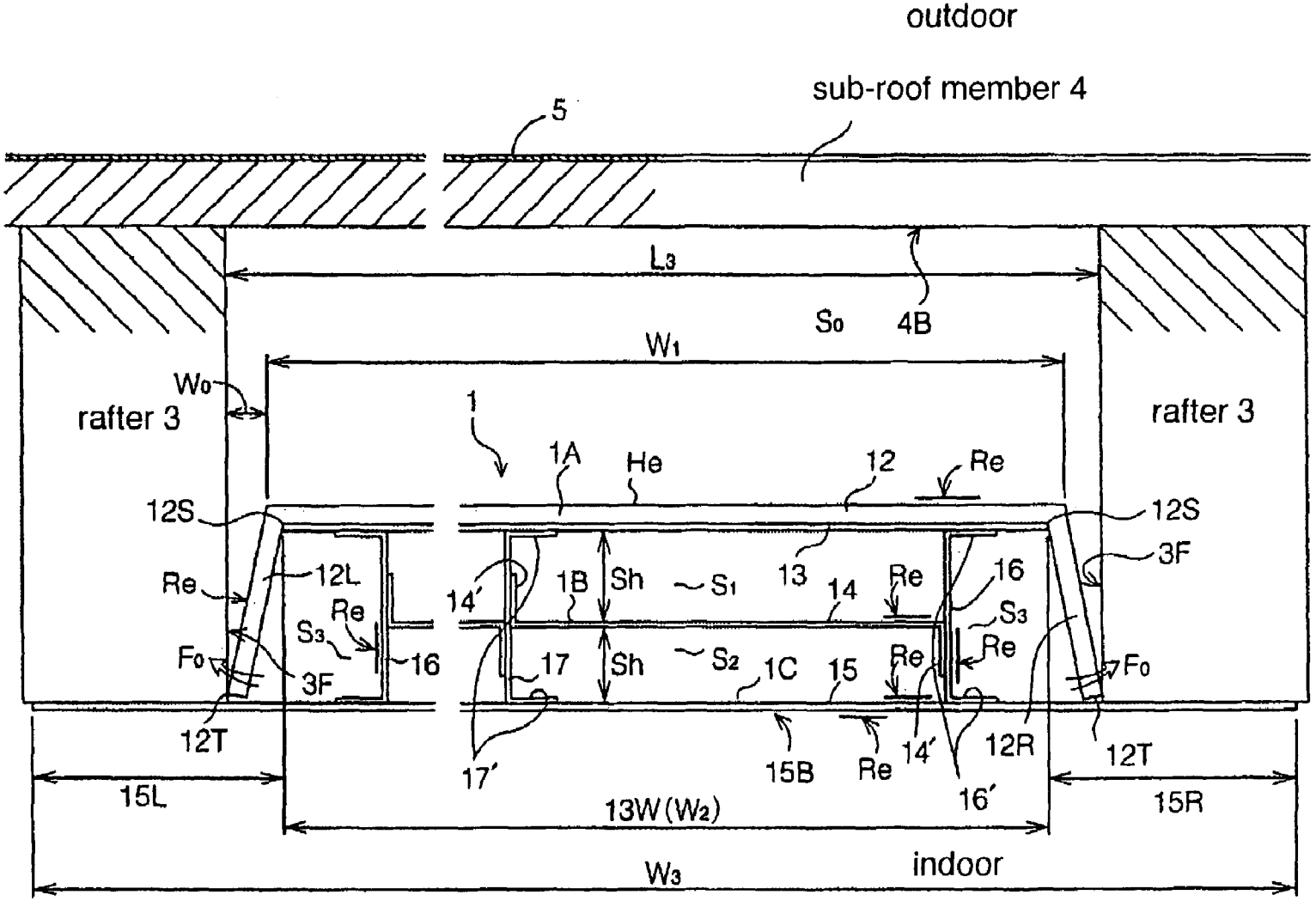
FIG. 2 is a front view of a thermal insulation structure to which the heat shielding member of FIG. 1 alone is fixed.

The Lower Sheet 15 is the Type Having the Extension Parts 15L, 15R [FIGS. 1, 2, 3]

As shown in FIG. 1, the type of the heat shielding member 1 to be engaged between the rafters 3 wherein the lower sheet 15 has the extension parts 15L, 15R at both sides in the width direction may be applied to that provided with the extension parts 15L, 15R serving as the bonding parts relative to the bottom face 3B of the rafters 3 at both sides of the same sheet (Paper 2) in the width direction during the fabrication of the heat shielding member 1 of the type according to First Embodiment (FIG. 4) wherein the dimensions of the extension parts 15L, 15R may be about 43 mm, thereby obtaining a sufficient fixture to the bottom face 3B of the rafters 3.

Third Embodiment

The Upper Layer 1A of Second Embodiment is Formed of the Shape-retention Upper Sheet 12 Alone The heat shielding member 1 shown in FIG. 6 has the structure in which the upper sheet 13 is removed from the heat shielding member 1 shown in FIG. 1 (Second Embodiment). When fabricating the heat shielding member 1, after the intermediate sheet 14, the lower sheet 15 and the stand-up pieces 16, 17 are subjected to the step of bending→providing an adhesive→press-bonding, the shape-retention upper sheet 12 (corrugated paper) in a flat state where the bent-up legs 12L, 12R are not bent may be subjected to bonding to the bent pieces 16', 17'.

Use of the Heat Shielding Member 1:

Application to a Roof:

Use of the Heat Shielding Member 1 of First Embodiment [FIG. 5]:

According to the heat shielding member 1 of First Embodiment (the type having the lower sheet 15 and the upper sheet 13 each having the same width), the sub-roof member 4 is extended on the rafters 3 and a commonly used waterproof layer 5 is provided on the sub-roof member 4 to prevent rainwater from entering the sub-roof member 4 downward, then the heat insulator 2 having a predetermined thickness is bonded to the bottom face 15B of the lower sheet 15 by an adhesive Ad with the interval L3 between the rafters 3 after or simultaneously with the installation of a roof finishing member to integrate them, thereafter the heat shielding member 1 is pushed and engaged between the rafters 3 from the indoor side while the bent-up parts 12S conform to the end edges 13E of the upper sheet 13 and creases are put to the bent-up parts 12S of the bent-up legs 12L, 12R.

In this case, the bent-up legs 12L, 12R are operated owing to the restorability of the bent-up parts 12S at the creases thereof such that the tip ends 12T thereof are brought into contact with and engaged between the side faces 3F of the rafters 3.

Figure 5A:
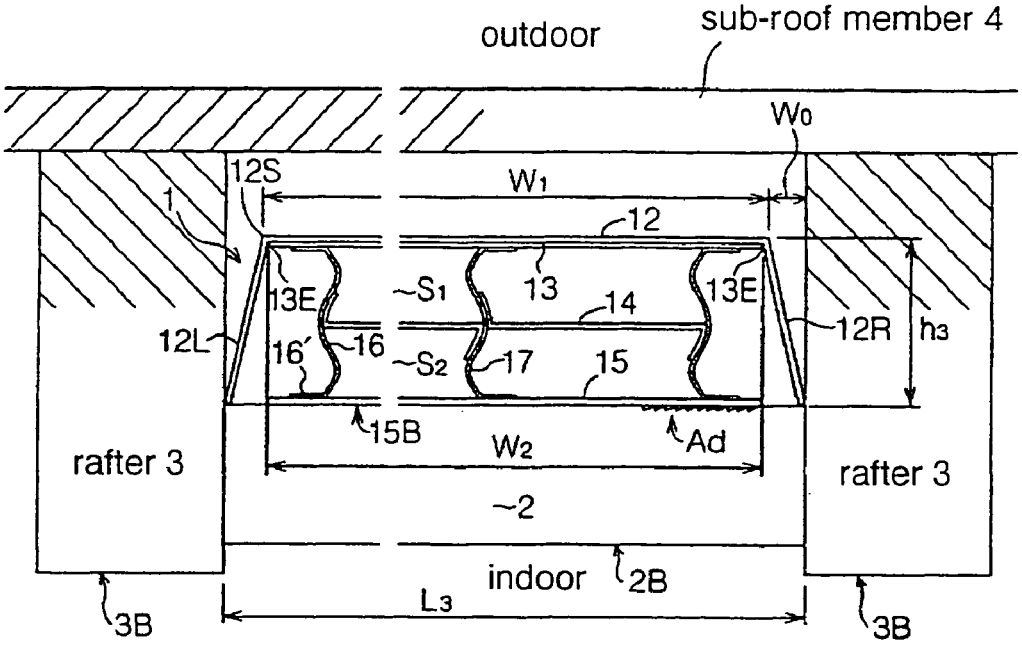
FIG. 5(A) is a view showing a pressed-in state and FIG. 5(B) is a view showing a fixing completion state.

Then, the bent-up legs 12L, 12R are inclined due to the difference of dimension W0 between the flat face width W1 of the upper layer 1A and the interval L3 between the rafters. In the course of pressing the heat shielding member 1 between the rafters 3, the bent-up legs 12L, 12R each has a height h3 which is slightly lower than the height h1 between the bent-up parts 12S and the lower sheet 15, and bear the press-in stress, and hence at the press-in completion position, both the stand-up pieces 16, 17 are slightly bent as shown in FIG. 5(A). However, when the heat insulator 2 is slightly pulled down to flush with the bottom face 3B of the rafters 3, the stand-up pieces 16, 17 properly stand up as shown in FIG. 5(B), whereby the tip ends 12T of the bent-up legs 12L, 12R of the shape-retention upper sheet 12 having shape retention property and restorability of corrugated paper are brought into contact with the side faces 3F in a stretched state owing to the restoring force F0 depicted by arrows, thereby properly and stably holding the upper layer 1A, the intermediate layer 1B, the lower layer 1C of the heat shielding member 1.

Figure 5B:
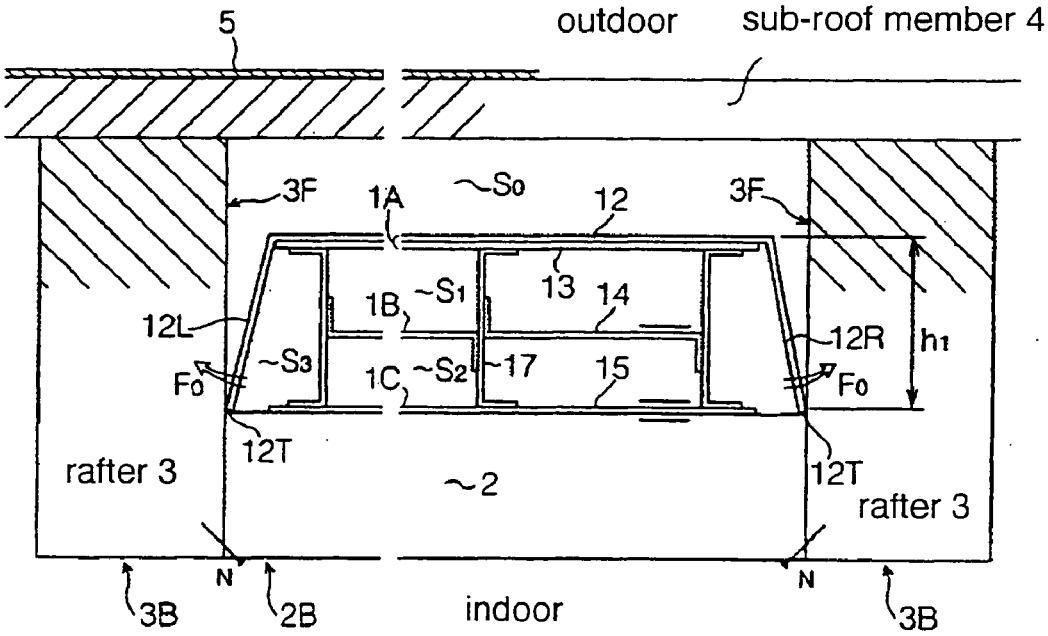

According to the thus obtained thermal insulation structure (FIG. 5(B)), there are stably secured the space S0 of the air layer formed between the upper layer 1A and the bottom face 4B of the sub-roof member 4, the space S1 of the air layer between the upper layer 1A and the intermediate layer 1B, the space S2 of the air layer between the intermediate layer 1B and the lower layer 1C, and the space S3 of the air layer between the bent-up legs 12L, 12R and both the end stand-up pieces 16, and radiant heat between respective layers can be discharged by the radiant heat reflective layers Re provided on each layer through the respective spaces S0, S1, S2, S3 of the air layer.

Accordingly, the transfer of a high temperature heating load transferred from the sub-roof member 4 toward the lower portion (inward) of the lower sheet 15 can be restrained, so that the amount heat accumulation in the heat insulator 2 disposed under the lower sheet 15 can be significantly reduced.

Since the bent-up legs 12L, 12R also have the radiant heat reflective layers Re on their front faces (outer faces) and the tip ends 12T are brought into contact with the side faces 3F owing to the restoring force F0, the entrance of air in the space S0 of the air layer which is rendered high in temperature toward the space S3 of the air layer at both side faces of both the end stand-up pieces 16 are restrained, thereby restraining the heating load applied to the heat insulator 2 positioned under the heat shielding member 1.

In this case, since an outside air gently enters the respective spaces S0, S1, S2, S3 of the air layer, the heat can be discharged outward by the radiant heat reflective layers Re of each layer, thereby restraining the downward transfer of heat in each layer.

Although the slightly exposed portion of the heat insulator 2 at both sides of the lower sheet 15 contacts the air inside the space S3 of the air layer, a thermal obstruction is within an allowable range.

Use of the Heat Shielding Member 1 of Second Embodiment [FIGS. 2 and 3]:

According to the heat shielding member 1 of Second Embodiment (the lower sheet 15 is the type having the extension parts 15L, 15R), the heat shielding member 1 having the bent-up legs 12L, 12R at the creases of the bent-up parts 12S formed on the upper layer 1A (shape-retention upper sheet 12) is engaged between the rafters 3 provided with the sub-roof member 4 and the waterproof layer 5 from the indoor side, then pressed between the rafters 3 until the extension parts 15L, 15R are brought into contact with the bottom face 3B of the rafters 3, then the extension parts 15L, 15R at both ends of the lower sheet 15 are brought into contact with and fixed to the single bottom face 3B of the rafters 3 in the manner that the extension parts 15L, 15R are superimposed on the single bottom face 3B, so that the thermal insulation structure of the roof can be formed by the heat shielding member 1 alone.

In this case, since the length of each of the bent-up legs 12L, 12R is substantially the same as the height h1 between the bent-up parts 12S and the lower sheet 15, the engagement and disposition of the heat shielding member 1 can be performed such that the bent-up legs 12L, 12R bear the press-in stress without any obstruction in operation to the spaces S1, S2 of the air layer.

Even if the dimensions of the extension parts 15L, 15R are not more than half the width of the bottom face 3B of the rafters 3, the extension parts 15L, 15R can be fixed to the rafters 3, but if the dimensions of the extension parts 15L, 15R are the same as or slightly smaller than the width 3W of the bottom face 3B of the rafters 3 like Second Embodiment, the extension parts 15L, 15R can be fixed to the bottom face 3B in a stacked form, enhancing the fixing operation.

Figure 3A:
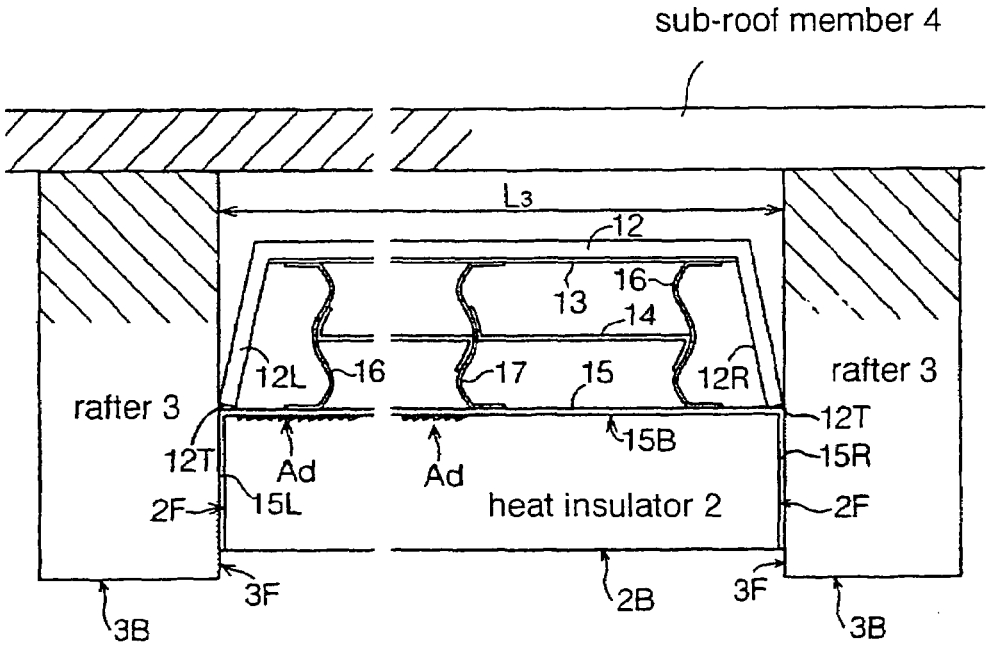
FIG. 3(A) is a view showing a pressed-in state and FIG. 3(B) is a view showing a fixing completion state.
Figure 3B:
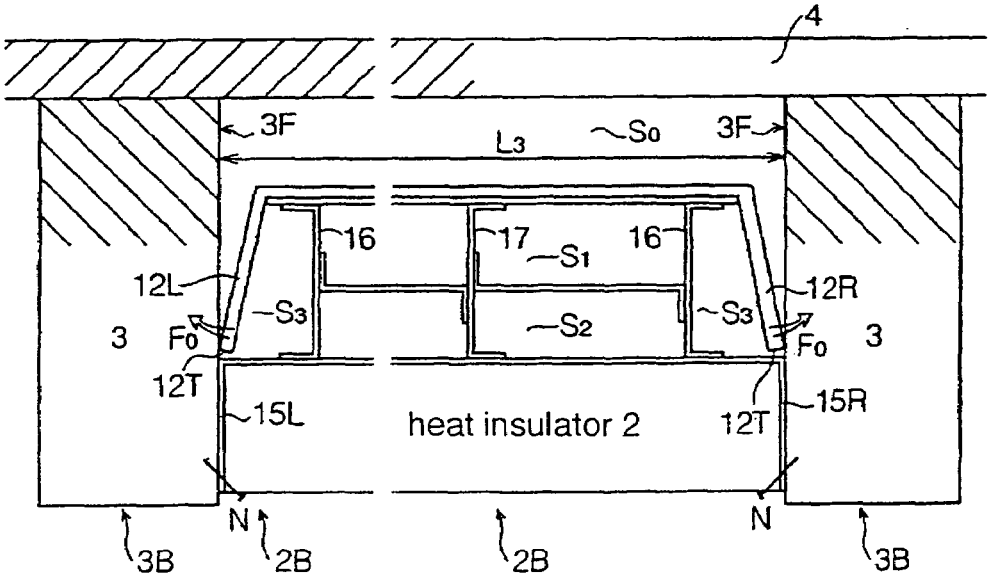

According to the thus obtained thermal insulation structure (FIG. 2) of the roof, a high temperature air in the space S0 of the air layer on the upper layer 1A is prevented from entering the space S3 of the air layer when the bent-up legs 12L, 12R are brought into contact with the side faces 3F of the rafters 3 owing to the restoring force F0, and the heat of high temperature air at the lower surface of the sub-roof member 4 is prevented from transferring as radiant heat toward the lower portion (inward) of the lower sheet 15 by the radiant heat reflective layers Re of each layer It is needless to say that the heat insulator 2 can be provided on the heat shielding member 1 of Second Embodiment. In this case, the heat insulator 2 is integrated with the lower sheet 15 by an adhesive Ad as shown in FIG. 3, and the extension parts 15L, 15R at both sides of the lower sheet 15 are bent and brought into contact with the side faces of the heat insulator 2 and pressed and engaged between the rafters 3 as shown in FIG. 3(A) or both the extension parts 15L, 15R are also pressed and engaged between the rafters 3 in a state where they are bonded to the side faces of the heat insulator 2, then the heat insulator 2 is slightly pulled back to render the bottom face 2B of the heat insulator 2 flush with the bottom face 3B of the rafters 3 in a state where the stand-up pieces 16, 17 stand upright, as shown in FIG. 3(B), thereafter the heat insulator 2 is fixed to the rafters 3 by nails N, and a commonly used moisture-proof layer may be provided on the bottom face 2B of the heat insulator 2, if necessary.

Figure 6A:
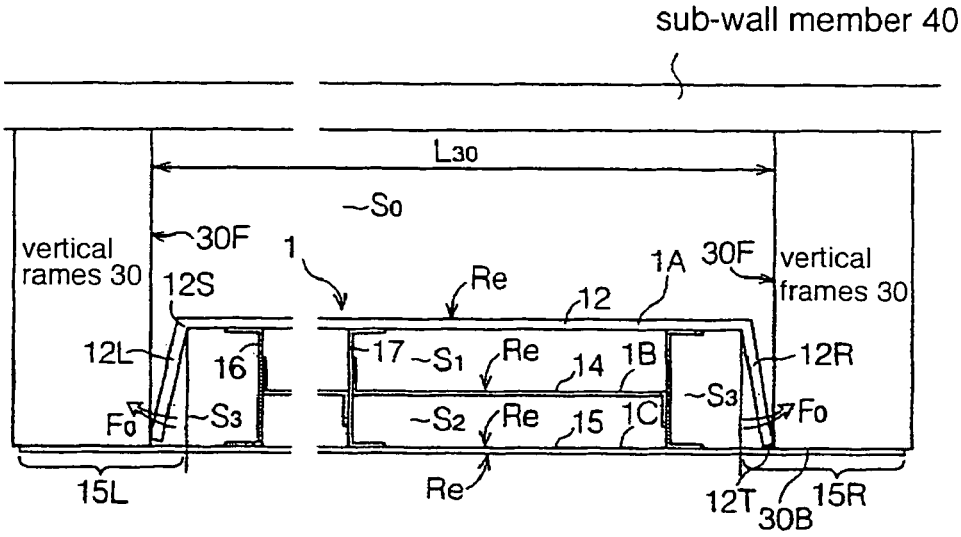
FIG. 6(A) shows a thermal insulation structure formed by the heat shielding member alone.
Figure 6B:
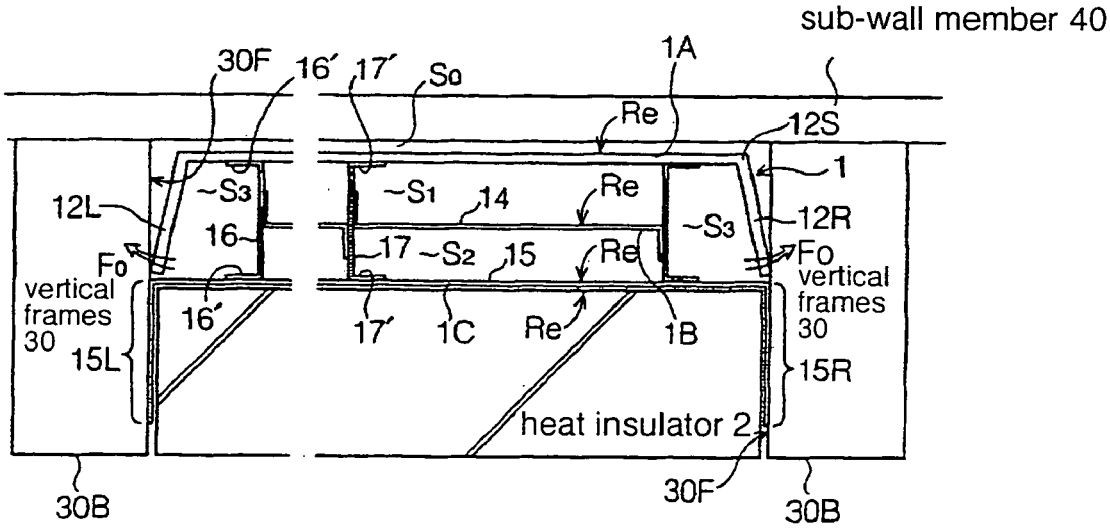
FIG. 6(B) shows a state where the heat insulator is provided on the heat shielding member.

Application to the Outer Wall:

Use of the Heat Shielding Member 1 of Third Embodiment [FIG. 6]:

FIGS. 6(A) and 6(B) are views showing the application of the heat shielding member 1 of Third Embodiment (the upper layer 1A is a type formed of the shape-retention upper sheet 12 alone) to the thermal insulation of the outer wall.

That is, FIG. 6(A) is a view showing the thermal insulation structure of the outer wall formed by the heat shielding member 1 alone, wherein the upper face width (W1) (FIG. 1) of the shape-retention upper sheet 12 is slightly smaller (10 to 20 mm) than the interval L30 between the respective vertical frames 30 on which a sub-wall member 40 for outer wall is stretched, while the shape-retention upper sheet 12 has bent-up legs 12L, 12R to which creases are put at the bent-up parts 12S in advance, and the heat shielding member 1 engaged between the vertical frames 30 from the indoor side, then the tip ends 12T of the bent-up legs 12L, 12R are pressed toward the side faces 30F while slidingly contact with the side faces 30F until the extension parts 15L, 15R are brought into contact with the bottom faces 30B of the vertical frames 30, and finally the extension parts 15L, 15R are brought into contact with the bottom faces 30B of the vertical frames 30 and fixed to the bottom faces 30B of the vertical frames 30 by an adhesive and the like.

The heat shielding member 1 forms the space S0 of the air layer between the sub-wall member 40 and the upper layer 1A, and the bent-up legs 12L, 12R form the space S3 of the air layer between themselves and both the end stand-up pieces 16 when the tip ends 12T are brought into contact with the side faces of the vertical frames 30 in a stretched state owing to the restoring force F0 at the bent-up parts 12S of the corrugated paper, whereby the heat shielding member 1 is held in a proper posture by the bent-up legs 12L, 12R at both side of the shape-retention upper sheet 12 to keep the spaces S1, S2 of the air layer between respective layers, thereby forming the structure to prevent the communication between the space S0 of the air layer and the space S3 of the air layer.

Further, FIG. 6(B) is an exemplified view showing a case where the heat shielding member 1 is used integrally with the heat insulator 2, and also showing a manner of use of the heat shielding member 1 such that the heat shielding member 1 of Third Embodiment is used and the heat insulator 2 is bonded and fixed to the lower sheet 15 and engaged between the vertical frames 30.

The heat insulator 2 has a width dimension conforming to the interval L30 between the respective vertical frames 30, and the bent-up legs 12L, 12R of the shape-retention upper sheet 12 are bent along the creases at the bent-up parts 12S in advance, and also the extension parts 15L, 15R of the lower sheet 15 are bent toward the side face of the heat insulator 2.

When the heat shielding member 1 is engaged and pressed between the vertical frames 30 while rendering the upper layer 1A to be directed as an outer face, the tip ends 12T of the bent-up legs 12L, 12R are stretched against the side faces 30F to hold the heat shielding member 1 at a proper position, thereby forming the space S0 of the air layer having a small interval between the upper layer 1A and the sub-wall member 40 and the space S3 of the air layer between the bent-up legs 12L, 12R and the both the end stand-up pieces 16 so that the heat shielding member 1 can be held in a proper posture, thereby keeping the spaces S1, S2 of the air layer between the respective layers.

It is needless to say that the heat shielding member 1 of Second Embodiment (FIG. 1) can be applied to the thermal insulation of an outer wall like the heat shielding member 1 of Third Embodiment (FIG. 6).

Figure 7A:
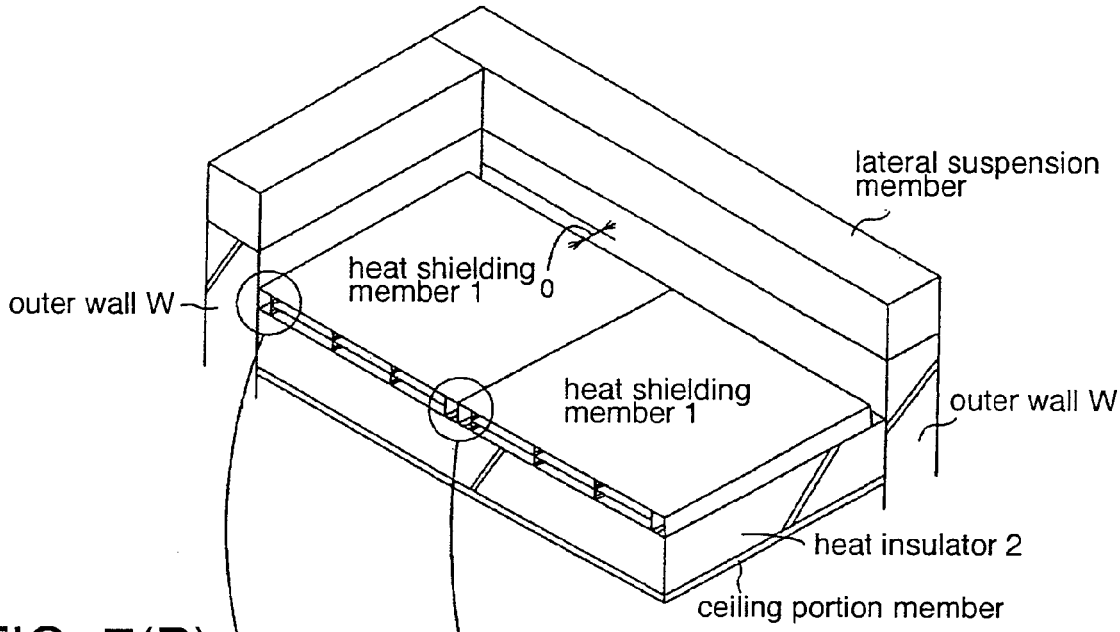
FIG. 7(A) is an entire view a part of which is cut away and FIG. 7(B) is enlarged views of encircled portions in FIG. 7(A)

Application to the Thermal Insulation of a Ceiling:

FIG. 7 shows an embodiment of application of the heat shielding member 1 of the type of Third Embodiment to the thermal insulation of a ceiling wherein the heat shielding members 1 are extended and disposed on the layer of the heat insulator 2 provided on the ceiling finishing member in a manner that the side faces of the heat shielding members 1 are brought into contact with each other, and the ends of the respective spaces of the air layer communicate with a small port O for ventilation, thereby restraining the heating and heat accumulation in the heat insulator 2.

Figure 7B:
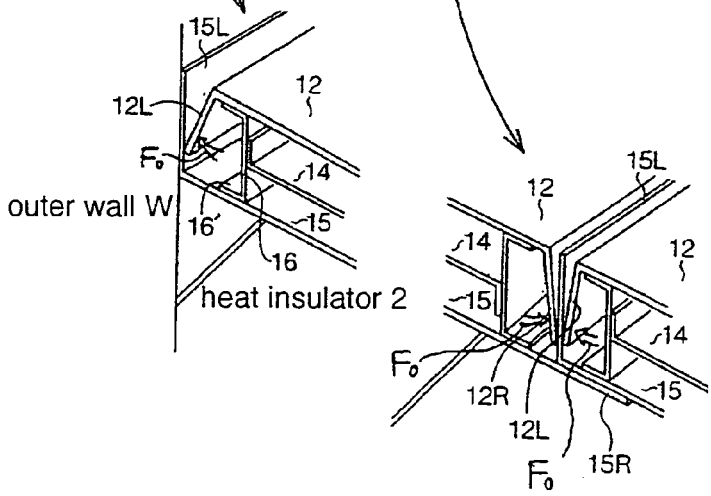

Although the ceiling finishing member has no intermediate partition member provided at a short interval like the rafters 3 and the vertical frames 30, the heat shielding member 1 is disposed, as shown in FIG. 7(B), such that the extension part 15L of the lower sheet 15 is bent at right angles, and the other extension part 15R is extended.

In this case, the heat shielding members 1 are brought into contact with and held by the outer wall at one bent-up leg 12L of the heat shielding member 1 and they can be positioned and held independently at the portion where the heat shielding members 1 are mutually brought into contact with each other owing to the shape retention restoring force of the bent-up legs 12L, 12R which are opposite to each other while intervening the vertical extension part 15L.

It is needless to say that the heat shielding member 1 can be positioned and held independently owing to the shape retention restoring force of the bent-up legs 12L, 12R even if the lower sheet 15 does not have extension parts 15L, 15R.

Even in the thermal insulation of the ceiling, the heat shielding member 1 can be independently held at a proper position by the bent-up legs 12L, 12R of the shape-retention upper sheet 12 having a shape retention property and the restorability.

Accordingly, not only the heat shielding member 1 of the type of Third Embodiment (FIG. 6) but also the heat shielding member 1 of the type of First Embodiment (FIG. 4) and the heat shielding member 1 of Second Embodiment (FIG. 4) can be applied to the thermal insulation of the ceiling, and nails, a tacker and the like are not required for holding the position of the heat shielding member 1 provided with the bent-up legs 12L, 12R having restorability.

According to the heat shielding member 1 of the preferred embodiments of the invention, since the constituent sheet members are all made of paper (Paper 1, Paper 2, Paper 3, Paper 4 and Paper 5) and excellent in a property of putting creases and adhesiveness, the fixation of the intermediate sheet 14 to the stand-up pieces 16, 17 and the fixation of the stand-up pieces 16, 17 to the lower sheet 15, the upper sheet 13 or the shape-retention upper sheet 12, which takes time in fabrication thereof, can be correctly and easily made in the flow process with the use of the group of rollers.

Further, it is possible to store the stand-up pieces 16, 17 in a laying down state (laminate state), so that the storage and transportation of the product are easily made.

Since the heat shielding member 1 is light because all the constituent members are made of paper, and the heat shielding member 1 can be used by merely cutting the stacked form of a reduced bulk to a necessary length, putting creases at the flat bent-up parts 12S at both sides of the shape-retention upper sheet 12 in a flat state, and standing up the stand-up pieces 16, 17 in the case of installation and use of the heat shielding member 1 so that the transportation to a installation site, preparation of use and the installation of the heat shielding member 1 are respectively easily made.

The installation of the thermal insulation of a roof applied between the rafters 3 is performed after the sub-roof member 4 is extended while the installation of the thermal insulation of the outer wall applied between the vertical frames 30 is performed from the indoor side, and the heat shielding member 1 can be installed even in a rainy day, and the period of time of installation of the thermal insulation can be shortened.

Further, the installation is performed from the indoor side using a stepladder, and it is not a dangerous operation at a high spot such as from the top of the roof as shown in FIGS. 8 and 9(B) of the prior art, so that the insulating operation becomes safe with good workability.

Since the heat shielding member 1 is a light product and the bent-up legs 12L, 12R exert a stretching force relative to the side thereof and holds the heat shielding member 1 owing to the restorability at the bent-up parts 12S of the corrugated paper having large shape retention property to which creases are put, the position of the heat shielding member 1 can be temporarily held, and the fixing operation of the heat shielding member 1 is easily made by merely engaging the heat shielding member 1 between the rafters 3 or the vertical frames 30.

The heat shielding member 1 restrains the transfer of heat toward the indoor side because the radiant heat reflective layer Re of the upper layer 1A reflects the radiant heat from the outside and discharges it through the space S0 of the air layer, and the intermediate layer 1B and the lower layer 1C reflect and discharge the transferred radiant heat through the spaces S1, S2 of the air layer, and also the space S3 of the air layer between both the end stand-up pieces 16 and the bent-up legs 12L, 12R reflect and discharge the radiant heat.

Meanwhile, the Foundation for Building Material Test Center measured heat transfer resistance, heat transfer coefficient, and heat resistance, respectively of a unit of the heat shielding member 1 (triple-layered configuration, and the height h1 is 40 mm) of First Embodiment (FIG. 4) having the radiant heat reflective layers Re on the faces of the upper layer 1A, the intermediate layer 1B and the lower layer 1C, and confirmed that the heat shielding member 1 exhibits the heat transfer resistance (0.92 $m^2 \cdot k/w$) which is substantially the same as a glass wool mat having the same thickness as the heat shielding member 1. That is, the heat shielding member 1 fulfills heat shielding function even under non-insolation condition.

Since the heat shielding member 1 has the radiant heat reflective layers Re at the upper and lower faces of the lower sheet 15, in the case of a summer season and the like where the outdoor temperature is higher than the indoor temperature, the face of the lower sheet 15 reflects the radiant heat and discharges it through the space S2 of the air layer to mitigate the heating load applied to the indoor.

Further, in the case of a winter season and the like where the indoor temperature is maintained to be higher than the outdoor temperature, the indoor heat is restrained from being transferred and discharged toward the outdoor, thereby achieving an energy saving effect in indoor heating.

Further, since the intermediate sheet 14 and the lower sheet 15 have multiple pinholes ho to render the heat shielding member 1 moisture-permeable, it is possible to prevent dew condensation inside the heat shielding member 1, thereby restraining dew condensation on the radiant heat reflective layer Re and contamination caused by mold growth, so that durability of the heat shielding function is improved. When the heat insulator 2 is provided and used integrally with the heat shielding member 1, the lowering of the thermal insulation function caused by the absorption of moisture is also restrained. According to the heat shielding member 1 of Second Embodiment (the type of the lower sheet 15 having the extension parts 15L, 15R), in a state where the heat shielding member 1 is in advance engaged and pressed between the rafters 3, the vertical frames of the wall, the timbers such as the base bars for a ceiling, the extension parts 15L, 15R of the lower sheet 15 are fixed to the side faces 3F (30F) by a tacker or nails, and the heat insulator 2 can be inserted into a space formed between the bottom face 15B of the lower sheet 15 and the extension parts 15L, 15R of the lower sheet 15. In this case, not only the engagement and installation of a solid heat insulator such as foam molded plastic and the like but also the filling and installation of a fiber based heat insulator such as a glass wool and the like can be performed, and if the fiber based heat insulator is employed, a moisture-proof layer may be provided at the indoor side.

Further, in the type of Third Embodiment (FIG. 6), the extension parts 15L, 15R of the lower sheet 15 can be removed.

In this case, when the heat shielding member 1 is engaged between the rafters 3 and the vertical frames 30 like the heat shielding member 1 of First Embodiment, the heat insulator 2 may be fixed to the bottom of the lower sheet 15.

Still further, the engagement and installation of the heat shielding member 1 can be applied to an interior of a section steel such as thin light section steel of an iron frame structure. The fixation of the lower sheet 15 to the steel material can be effected by a double-sided adhesive tape, a drilling tapping, screws and the like.

More still further, a bulk of thick paper or plastic sheet may be sufficient as the shape-retention upper sheet 12, if it can fulfill the function of the necessary restoring force F0 at the creases of the bent-up parts 12S. In the case of the plastic sheet, it is desirable to have moisture permeability by perforating it to form pinholes.

Since the heat shielding member 1 of the present invention can be engaged between the timbers such as the rafters 3 and the vertical frames and the like, to which the heat shielding member 1 is applied and mounted, from the upper layer 1A side, a safe and easy installation can be performed by using a stepladder and the like from the indoor side.

Accordingly, it is possible to perform installation in a state where the heat shielding member 1 does not get wet by rain after installation of the sub-roof member 4 and the sub-wall member 40, whereby the operation during a rainy day can be performed, thereby shortening a construction period, and the heat shielding member 1 which has been fixed to the rafters 3 and the like in a state where it does not get wet provides a durable thermal insulation structure in which neither mold growth nor rot caused by absorption of water occurs during the service life thereof.

Further, since the heat shielding member 1 is held in its position by the bent-up legs 12L, 12R having restorability which are stretched against the side surfaces of the timbers such as the rafters 3 and the like, the heat shielding member 1 is temporarily fixed when it is engaged between the timbers so that the fixing operation of the heat shielding member 1 to the timbers such as the rafters 3 is easily made, and hence the heat shielding member 1 can be held in a proper position with a proper posture by the bent-up legs 12L, 12R during the service life thereof after the installation thereof and it fulfills a heat shielding function at a value as designed.

Still further the thermal insulation structure obtained by the fixation of the heat shielding member 1 alone provides the thermal insulation structure which is easy in fixing operation without providing heat accumulation, while the thermal insulation structure to which the heat shielding member 1 is fixed so as to cover and protect the heat insulator 2 can render the thickness of the heat insulator 2 thin, and also the heat shielding member 1 controls to mitigate the heating load applied to the heat insulator 2 so that the amount of heat accumulation in the heat insulator 2 can be significantly restrained.

Still further, when the heat shielding member 1 is applied between the timbers such as the roof rafters and vertical frames of a wall, the bent-up legs 12L, 12R having radiant heat reflective layers Re on their faces (outer faces) are brought into contact with the side faces 3F (30F) with a restoring force F0 to hold the heat shielding member 1 at a proper position so that the bent-up legs 12L, 12R prevent a high temperature air over the upper layer 1A from entering the side faces (space S3 of the air layer) of the heat shielding member 1 in addition to the effect of the radiant heat reflective layers Re provided on the upper faces of the respective layers 1A, 1B, 1C of the heat shielding member and the outer side faces of both the end stand-up pieces 16, so that the heat shielding member 1 can preferably restrain the transfer of the heat from the outdoor side to the indoor side.

Further, since the pinholes ho are dispersedly disposed on the intermediate sheet 14 and the lower sheet 15 of the heat shielding member 1, dew condensation inside the heat shielding member 1 can be prevented and contamination of the radiant heat reflective layer Re caused by dew condensation and mold growth can be prevented, thereby restraining the lowering of the radiant heat reflecting function.

More still further, since the radiant heat reflective layers Re are provided on both sides of the lower sheet 15 of the heat shielding member 1, the heat shielding member 1 not only restrains the transfer of a high temperature heat in a summer season from the outdoor side to the indoor side, thereby reducing the cooling energy in the room but also restrains the transfer of the heat of the indoor heating in a winter season from the heat shielding member to the outdoor side, thereby reducing the heating energy in the room so that energy saving housing can be provided.

Further, since the extension parts 15L, 15R are formed on the lower sheet 15 of the heat shielding member 1 at both sides as fixtures, the thermal insulation structure can be formed by the heat shielding member alone by merely engaging the heat shielding member 1 between the timbers (rafters, vertical frames) and fixing to the lower surfaces of the timbers by the extension parts 15L, 15R, while if the extension parts 15L, 15R are bent toward the side faces of the heat insulator 2 and engaged between the timbers together with the heat shielding member 1, so that the thermal insulation structure wherein the heat insulator 2 is covered with the heat shielding member 1 can be formed, thereby making it possible to apply an appropriate thermal insulation structure to housing at appropriate spots, and also making it possible to provide housing having a reasonable thermal insulation structure.

What is claimed is:

1. A heat shielding member of a house comprising a plurality of layers, comprised of an upper layer including at least a shape-retention upper sheet and a lower layer made up of a lower sheet;

spaces of an air layer formed between respective layers which are coupled by a group of stand-up pieces and having an opening enabling ventilation in the longitudinal direction; and radiant heat reflective layers provided on respective upper faces of the layers, for defining bottom faces of the respective spaces of the air layer and an upper face of the upper layer;

said shape-retention upper sheet having bent-up legs at both sides having restorability at bent-up parts.

2. The heat shielding member of a house according to claim 1, wherein outer faces of the stand-up pieces and upper and lower faces of the lower sheet are provided with the radiant heat reflective layers, and pin holes for moisture permeability are dispersedly disposed on the entire faces of an intermediate sheet constituting an intermediate layer and the lower sheet.

3. The heat shielding member of a house according to claim 1, wherein the upper layer comprises an upper sheet and the shape-retention upper sheet laminated to the upper sheet, and the group of stand-up pieces are coupled and fixed to the lower sheet and the upper sheet to be freely laid down.

4. The heat shielding member of a house according to claim 1, wherein both end edges of the upper sheet define bent-up parts of the bent-up legs of the shape-retention upper sheet and the lower sheet has the same width as the upper sheet.

5. The heat shielding member of a house according to claim 1, wherein the upper layer is made up of the shape-retention upper sheet, and the group of the stand-up pieces are fixed between the lower sheet and the shape-retention upper sheet to be freely laid down.

6. The heat shielding member of a house according to claim 1, wherein the lower sheet has extension parts at both sides thereof.

7. The heat shielding member of a house according to claim 1, wherein the shape-retention upper sheet defines a flat face width of the upper layer between the bent-up parts at both sides and has the bent-up legs having substantially the same dimensions as a height between the bent-up parts and the lower sheet.

8. The heat shielding member of a house according to claim 1, wherein the shape-retention upper sheet is made up of corrugated paper, and other sheets and the stand-up pieces are made up of Kraft paper, and the radiant heat reflective layer is an aluminum foil stuck layer.

* * * * *